US009794698B2

(12) United States Patent
Hillbratt et al.

(10) Patent No.: US 9,794,698 B2
(45) **Date of Patent: *Oct. 17, 2017**

(54) SIGNAL PROCESSING FOR HEARING PROSTHESES

(71) Applicant: Cochlear Limited, Macquarie University (AU)

(72) Inventors: Martin E. G. Hillbratt, Lindome (SE); Mark C. Flynn, Gothenburg (SE)

(73) Assignee: Cochlear Limited, Macquarie University, NSW (AU)

( * ) Notice: Subject to any disclaimer, the term of this patent is extended or adjusted under 35 U.S.C. 154(b) by 63 days.

This patent is subject to a terminal disclaimer.

(21) Appl. No.: 14/919,372

(22) Filed: Oct. 21, 2015

(65) Prior Publication Data

US 2016/0127840 A1 May 5, 2016

Related U.S. Application Data

(63) Continuation of application No. 13/911,300, filed on Jun. 6, 2013, now Pat. No. 9,179,222.

(51) Int. Cl.
*H04R 25/00* (2006.01)

(52) U.S. Cl.
CPC ..... *H04R 25/353* (2013.01); *H04R 25/43* (2013.01); *H04R 25/505* (2013.01); *H04R 25/606* (2013.01); *H04R 2225/43* (2013.01); *H04R 2460/13* (2013.01)

(58) Field of Classification Search
USPC ..... 381/23.1
See application file for complete search history.

(56) References Cited

U.S. PATENT DOCUMENTS

| | | | | |
|---|---|---|---|---|
| 5,027,410 | A | 6/1991 | Williamson et al. | |
| 5,961,443 | A | 10/1999 | Rastatter et al. | |
| 8,050,436 | B2 | 11/2011 | Kasanmascheff | |
| 8,483,416 | B2 | 7/2013 | Roeck et al. | |
| 9,179,222 | B2 | 11/2015 | Hillbratt et al. | |
| 2004/0264721 | A1* | 12/2004 | Allegro | H04R 25/353 381/316 |

(Continued)

FOREIGN PATENT DOCUMENTS

| | | | |
|---|---|---|---|
| EP | 2 375 782 | A1 | 10/2001 |
| EP | 1 333 700 | A2 | 8/2003 |
| EP | 1 441 562 | A2 | 7/2004 |

(Continued)

*Primary Examiner* — Amir Etesam

(57) ABSTRACT

A method includes programming a sound processor to apply frequency shifting on a stimulation signal to generate a frequency shifted stimulation signal. The frequency shifting depends on one or more of a decibel level of a received sound signal, a hearing loss level associated with generating the stimulation signal, attenuation of an output based on the frequency shifted stimulation signal, or operating a hearing prosthesis in a single sided mode or a bilateral mode. The method includes receiving a sound signal, generating the stimulation signal from the sound signal, applying the frequency shifting to the stimulation signal to generate the frequency shifted stimulation signal, and generating, by an actuator of the hearing prosthesis, the output based on the frequency shifted stimulation signal, wherein the output is configured to be perceived as sound.

20 Claims, 2 Drawing Sheets

(56) References Cited

U.S. PATENT DOCUMENTS

| | | | |
|---|---|---|---|
| 2005/0226447 | A1 | 10/2005 | Miller, III |
| 2006/0155346 | A1 | 7/2006 | Miller, III |

FOREIGN PATENT DOCUMENTS

| | | | |
|---|---|---|---|
| EP | 2 026 601 | A1 | 2/2009 |
| EP | 1 920 632 | B1 | 11/2009 |
| EP | 2 360 945 | A2 | 8/2011 |

* cited by examiner

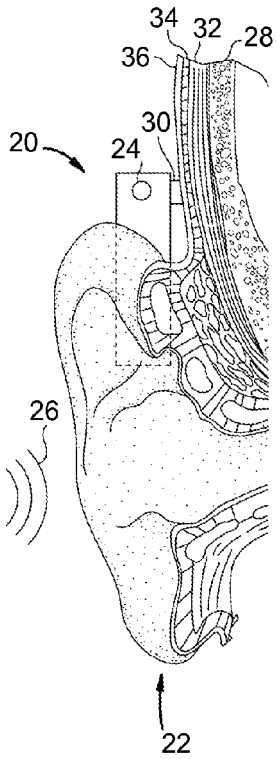
FIG. 1
FIG. 2
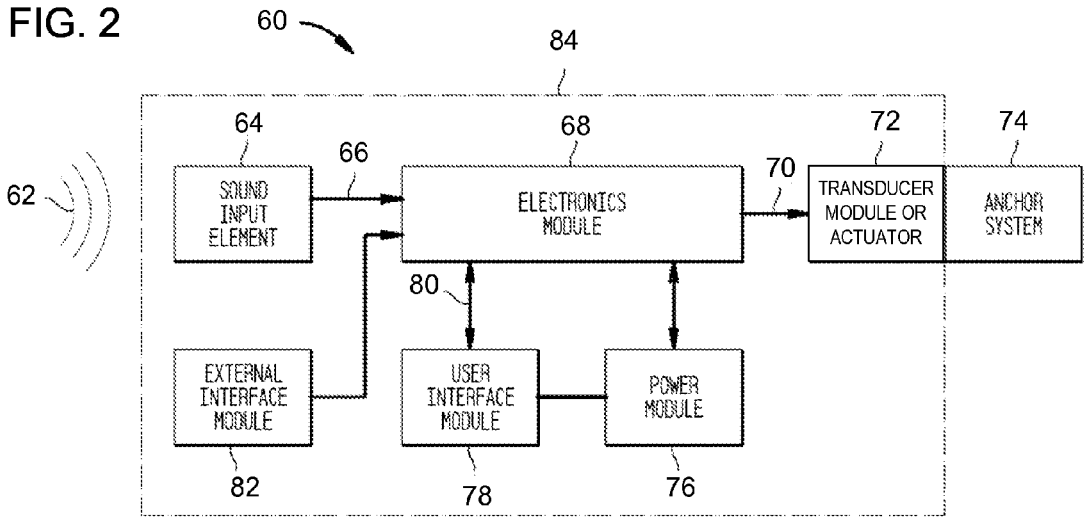

SIGNAL PROCESSING FOR HEARING PROSTHESES

CROSS-REFERENCE TO RELATED APPLICATIONS

This is a continuation of U.S. patent application Ser. No. 13/911,300 filed on Jun. 6, 2013, which will issue as U.S. Pat. No. 9,179,222 on Nov. 3, 2015, the contents of each of which are hereby incorporated by reference.

BACKGROUND

Various types of hearing prostheses may provide persons with different types of hearing loss with the ability to perceive sound. Hearing loss may be conductive, sensorineural, or some combination of both conductive and sensorineural. Conductive hearing loss typically results from a dysfunction in any of the mechanisms that ordinarily conduct sound waves through the outer ear, the eardrum, or the bones of the middle ear. Sensorineural hearing loss typically results from a dysfunction in the inner ear, including the cochlea where sound vibrations are converted into neural signals, or any other part of the ear, auditory nerve, or brain that may process the neural signals.

Persons with some forms of conductive hearing loss may benefit from hearing prostheses, such as acoustic hearing aids or vibration-based hearing devices. An acoustic hearing aid typically includes a small microphone to detect sound, an amplifier to amplify certain portions of the detected sound, and a small speaker to transmit the amplified sounds into the person's ear.

Vibration-based hearing devices typically include a small microphone to detect sound and a vibration mechanism to apply vibrations corresponding to the detected sound directly or indirectly to a person's bone or teeth, thereby causing vibrations in the person's inner ear and bypassing the person's auditory canal and middle ear. Vibration-based hearing devices include, for example, bone conduction devices, direct acoustic cochlear stimulation devices, or other vibration-based devices. A bone conduction device typically utilizes a surgically implanted mechanism or a passive connection through the skin or teeth to transmit vibrations corresponding to sound via the skull. A direct acoustic cochlear stimulation device also typically utilizes a surgically implanted mechanism to transmit vibrations corresponding to sound, but bypasses the skull and more directly stimulates the inner ear. Other non-surgical vibration-based hearing devices may use similar vibration mechanisms to transmit sound via direct or indirect vibration of teeth or other cranial or facial bones or structures.

Persons with certain forms of sensorineural hearing loss may benefit from hearing prostheses, such as cochlear implants and/or auditory brainstem implants. For example, cochlear implants can provide a person having sensorineural hearing loss with the ability to perceive sound by stimulating the person's auditory nerve via an array of electrodes implanted in the person's cochlea. A microphone of the cochlear implant detects sound waves, which are converted into a series of electrical stimulation signals that are delivered to the implant recipient's cochlea via the array of electrodes. Auditory brainstem implants can use technology similar to cochlear implants, but instead of applying electrical stimulation to a person's cochlea, auditory brainstem implants apply electrical stimulation directly to a person's brain stem, bypassing the cochlea altogether. Electrically stimulating auditory nerves in a cochlea with a cochlear implant or electrically stimulating a brainstem may enable persons with sensorineural hearing loss to perceive sound.

Further, some persons may benefit from hearing prostheses that combine one or more characteristics of the acoustic hearing aids, vibration-based hearing devices, cochlear implants, and auditory brainstem implants to enable the person to perceive sound. Such hearing prostheses can be referred to generally as bimodal hearing prostheses. Generally, the term bimodal means more than one stimulation mode, and not necessarily only two stimulation modes.

The effectiveness of a hearing prosthesis depends on the design of the prosthesis itself and on how well the prosthesis is configured for or fitted to a prosthesis recipient. The fitting of the prosthesis, sometimes also referred to as programming or mapping creates a set of configuration settings and other data that define the specific characteristics of the signals (acoustic, mechanical, or electrical) delivered to the relevant portions of the person's outer ear, middle ear, inner ear, auditory nerve, or skull. This configuration information may also include a prescription rule that defines a relationship between audio input parameters and output parameters for audio frequency channels of the hearing prosthesis.

Referring more particularly to acoustic hearing aids, an example prescription rule can include applying frequency shifting to process incoming sound before applying amplified sounds into the person's ear. Frequency shifting in the context of acoustic hearing aids is performed primarily to move sound information from impaired higher frequency regions of the cochlea to better functioning lower frequency regions of the cochlea.

SUMMARY

While frequency shifting has been used in the context of acoustic hearing aids to move sound information from impaired higher frequency regions to better functioning lower frequency regions of the cochlea, this same reason may not be an issue with other types of hearing prostheses. For instance, in the context of vibration-based hearing devices, recipients of such devices may maintain some useable hearing capabilities for higher frequency sounds. Thus, frequency shifting is not generally needed to shift sound information from higher to lower frequency regions of the cochlea.

However, in accordance with the present disclosure, frequency shifting is applied in vibration-based hearing devices and other types of hearing prostheses, although for different reasons and using different frequency shifting techniques than in the case of acoustic hearing aids. For example, in the present disclosure, frequency shifting can be applied in a vibration-based hearing device to compensate for the attenuation of higher frequency sound signals that are transmitted through the skin and/or bone as vibration. Another reason to apply frequency shifting in a vibration-based hearing device is to help minimize the effect of feedback associated with higher frequency sounds signals.

Further, frequency shifting can be applied to compensate for limitations of a vibration-based hearing device or other type of hearing prosthesis to deliver higher frequency electrical signals that can be perceived as sound by the recipient. For example, a hearing prosthesis may not be powerful enough to deliver electrical signals that can be perceived as sound by a recipient at frequencies between about 3 kHz to 8 kHz. These output limitations depend in part on the design of the device and on the hearing loss of the recipient. In any event, once an output limit is identified, such as during a fitting session, frequency shifting can be applied to electrical signals above the limit.

For these and perhaps other reasons, frequency shifting is applied in hearing prostheses in accordance with the present disclosure. In one example, this frequency shifting includes level dependent frequency shifting, in which one or more parameters of the frequency shifting are dependent on an input sound level and/or a hearing loss level. Such parameters may include, for example, an amount of frequency content to be shifted, an extent of the frequency shifting, whether frequency shifted content replaces or mixes with other sound content, etc.

In another example, a frequency shifting system or method is disclosed that is dependent on operating parameters of the hearing prosthesis. For instance, frequency shifting can be applied differently based on whether the device is operating in a single-sided mode or a bilateral mode or based on different listening situations, such as speech, noise, music, etc. In yet another example, a frequency shifting system or method is disclosed that performs a voice-dependent frequency shifting, in which the frequency shifting is dependent on one or more frequency bands associated with a voice of a hearing prosthesis recipient. In a further example, a frequency shifting system or method can be dependent on other parameters of the hearing prosthesis, such as whether a vibration-based hearing device includes a transcutaneous or percutaneous coupling to a recipient.

These different frequency shifting are applicable to vibration-based hearing devices but also may be applied in other types of hearing prostheses in order to increase audibility of high frequency sounds, to improve the localization effect in single-sided or bilateral operating modes, and to improve sound quality by altering the frequency for softer sounds while louder sounds are allowed to produce a natural hearing response in the recipient, for example.

The above and additional aspects, examples, and embodiments are further described in the present disclosure.

BRIEF DESCRIPTION OF THE DRAWINGS

FIG. 1 illustrates a hearing prosthesis, in this case, a bone conduction device that is coupled to a recipient, in accordance with one example of the present disclosure.

FIG. 2 illustrates a block diagram of a hearing prosthesis system according to an embodiment of the present disclosure.

DETAILED DESCRIPTION

Figure 3:
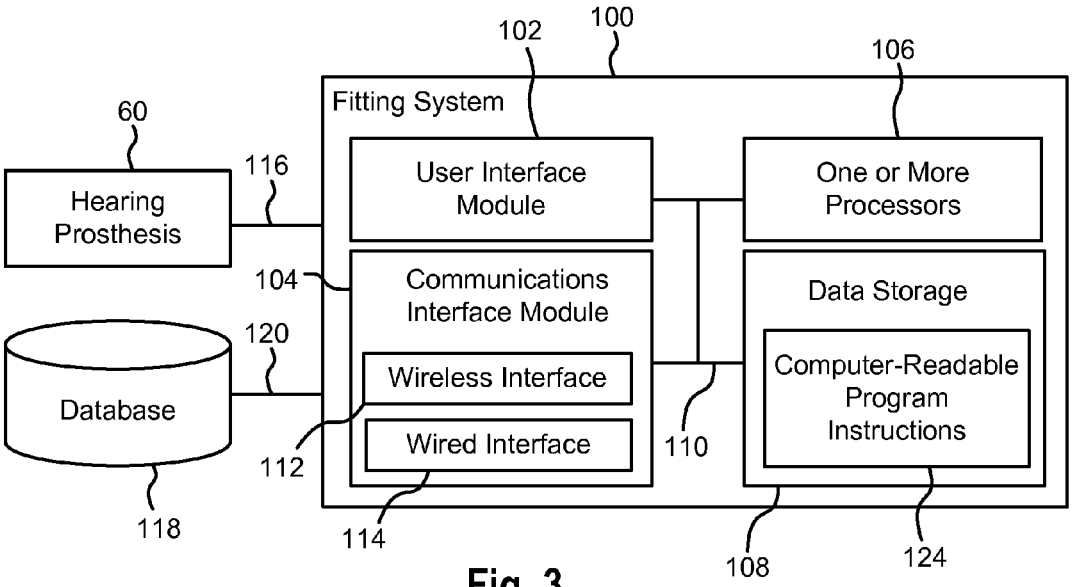
FIG. 3 illustrates a block diagram of a fitting system for a hearing prosthesis according to an embodiment of the present disclosure.

The following detailed description sets forth various features and functions of the disclosed devices, systems, and methods with reference to the accompanying figures. In the figures, similar symbols typically identify similar components, unless context dictates otherwise. The illustrative embodiments described herein are not meant to be limiting. Certain aspects of the disclosed devices, systems, and methods can be arranged and combined in a variety of different configurations, all of which are contemplated herein. For illustration purposes, some features and functions are described with respect to vibration-based hearing devices. However, various features and functions disclosed herein may be applicable to other types of hearing prostheses and, more particularly, to hearing prostheses that have high-frequency output limitations.

FIG. 1 is a perspective view of an example vibration-based hearing prosthesis in accordance with one embodiment of the present disclosure. More particularly, FIG. 1 depicts a vibration-based hearing device 20 positioned behind an outer ear 22 of a recipient to aid in the perception of sound. The vibration-based hearing device 20 includes a sound input element 24 to receive sound signal 26. The sound input element 24 can be a microphone, telecoil, or similar device. In the depicted example, the sound input element 24 is located on the vibration-based hearing device 20. However, in other embodiments, the sound input element 24 can be located in the vibration-based hearing device 20 or, alternatively, on a cable extending from the vibration-based hearing device. The vibration-based hearing device 20 additionally includes a sound processor, a vibrating electromagnetic actuator, and/or various other operational components.

In accordance with an example operation of the vibration-based hearing device 20, the sound input device 24 converts the sound signal 26 into an electrical signal. This electrical signal is then processed by the sound processor (not shown) to generate a stimulation signal that causes the actuator to vibrate. In other words, the actuator converts the stimulation signal into mechanical force to impart vibration to skull bone 28 of the recipient.

In the example depicted, the vibration-based hearing device 20 further includes a coupling apparatus 30 to attach the vibrating actuator of the vibration-based hearing device to the recipient. In the present example, the coupling apparatus 30 is attached to an anchor system (not shown) implanted in the recipient. Some example anchor systems (which are sometimes referred to as fixation systems) include a percutaneous abutment fixed to the recipient's skull bone 28. The percutaneous abutment extends from the skull bone 28 through muscle 32, fat 34 and skin 36 so that the coupling apparatus 30 may be attached directly thereto. Such a percutaneous abutment provides an attachment location for the coupling apparatus 30 that facilitates efficient transmission of mechanical force.

Another example anchor system includes a transcutaneous component, such as a magnet, that is implanted under the skin 36 of the recipient. In this example, the coupling apparatus 30 can magnetically couple to the transcutaneous component and mechanical force (e.g., vibration) is transmitted through the skin to the skull bone 28. In another example, the transcutaneous component can be a transducer, such as a vibration mechanism, which is implanted under the skin 36 and attached to the bone 28. In this example, the device 20 can be magnetically coupled to the transducer component through the skin 36 of the recipient. In transcutaneous coupling configurations, the skin flap between the device 20 and the bone 28 causes attenuation of sound signals transmitted through the skin and/or bone as vibration. Generally, this attenuation has a greater effect for higher-frequency sound signals and greater skin flap thicknesses.

FIG. 2 depicts a functional block diagram of one example of a hearing prosthesis 60, such as a vibration-based hearing prosthesis (e.g. the vibration-based hearing device 20 of FIG. 1). However, as described above, the features and associated functionality described with reference to the hearing prosthesis 60 may be equally applicable to other types of hearing or medical prostheses.

In operation, a sound signal 62 is received by a sound input element 64. In some arrangements, the sound input element 64 is a microphone configured to receive the sound signal 62, and to convert the sound signal into an electrical signal 66. Alternatively, the sound signal 62 is received by the sound input element 64 as an electrical signal, such as via an input jack, for example.

As further depicted in FIG. 2, the electrical signal 66 is provided by the sound input element 64 to an electronics module 68. The electronics module 68 is configured to convert the electrical signal 66 into an adjusted electrical signal 70. Generally, the electronics module 68 may include a sound processor, data storage with computer-readable program instructions, control electronics, transducer drive components, and a variety of other elements, including, but not limited to one or more processors.

In one example of the present disclosure, the electronics module 68 includes hardware and/or software components that apply frequency shifting to convert the electrical signal 66 into a frequency shifted, adjusted electrical signal 70. In this example, the electronics module 68 can include a specific meta trimmer or other control mechanism to adjust the degree of frequency shifting, which can also be combined with level shifting of the electrical signal.

The electronics module 68 can also include an expert system that modifies frequency shifting based on data logging and machine learning of different configurations or parameters of the hearing prosthesis, for example. Illustratively, the expert system can track user adjustments to a volume control of the hearing prosthesis to determine whether a greater or lesser degree of frequency shifting should be applied presently and/or in the future. Thus, for example, if the expert system determines that a user repeatedly increases the volume for a range of incoming sound frequencies, then the system may apply less frequency shifting for that range of incoming sound frequencies. The expert system can also track adjustments made during a fitting session of the hearing prosthesis to modify frequency shifting.

As further depicted in FIG. 2, when the hearing prosthesis 60 is a vibration-based hearing device, a transducer module or actuator 72 receives the adjusted electrical signal 70 and generates a mechanical output force that is delivered in the form of a vibration to the skull of the recipient via an anchor system 74. Delivery of this output force causes motion or vibration of the recipient's skull, thereby activating the hair cells in the recipient's cochlea via cochlea fluid motion. In other types of devices, the anchor system 74 is omitted and the transducer module 72 generates other types of stimulation (e.g., acoustic, mechanical, or hybrid stimulation, such as acoustic and electric, for example) for application to the recipient.

FIG. 2 also illustrates a power module 76. The power module 76 provides electrical power to one or more components of the hearing prosthesis 60. For ease of illustration, the power module 76 has been shown connected only to a user interface module 78 and the electronics module 68. However, it should be appreciated that the power module 76 may be used to supply power to any electrically powered circuits/components of the hearing prosthesis 60.

The user interface module 78 allows a user to interact with the hearing prosthesis 60. For example, the user interface module 78 may allow the user to adjust the volume, alter speech processing strategies, power on/off the device, etc. In the example of FIG. 2, the user interface module 78 communicates with the electronics module 68 via signal line 80. In one aspect of the present disclosure, the user interface module 78 includes a volume control that can be used to adjust the gain of electrical signals applied to the recipient. The electronics module 68 can also use adjustments to the volume control (and/or other controls) to control frequency shifting. Further, the electronics module 68 can control frequency shifting based on computer learning algorithms or processes applied to adjustments to the interface module 78.

The hearing prosthesis 60 may further include an external interface module 82 to connect the electronics module 68 to an external device, such as a fitting system 100 depicted in FIG. 3. Using the external interface module 82, the external device may obtain information from the hearing prosthesis 60 (e.g., the current parameters, data, alarms, prescription information, etc.) and/or modify the parameters of the hearing prosthesis 60 used in processing received sounds and/or performing other functions.

In the example of FIG. 2, the sound input element 64, electronics module 68, transducer module 72, power module 76, user interface module 78, and external interface module 82 have been shown as integrated in a single housing 84. However, it should be appreciated that in certain examples, one or more of the illustrated components may be housed in separate or different housings. Similarly, it should also be appreciated that in such embodiments, direct connections between the various modules and devices are not necessary and that the components may communicate, for example, via wireless connections.

FIG. 3 shows a block diagram of an example of a fitting system 100 that is configurable to execute fitting software for a particular hearing prosthesis and to load configuration settings and prescription information to the hearing prosthesis via the external interface module 82. As shown in FIG. 3, the fitting system 100 includes a user interface module 102, a communications interface module 104, one or more processors 106, and data storage 108, all of which may be linked together via a system bus or other connection circuitry 110. In other examples, the fitting system 100 may include more, fewer, or different modules than those shown in FIG. 3.

In the fitting system 100 shown in FIG. 3, the user interface module 102 is configured to send data to and/or receive data from external user input/output devices such as a keyboard, keypad, touch screen, computer mouse, track ball, joystick, and/or other similar device, now known or later developed. The user interface module 102 is also configured to provide output to user display devices, such as one or more cathode ray tubes (CRT), liquid crystal displays (LCD), light emitting diodes (LEDs), displays using digital light processing (DLP) technology, printers, light bulbs, and/or other similar devices, now known or later developed. Furthermore, in some embodiments, the user interface module 102 is configured to generate audible output(s), such as through a speaker, speaker jack, audio output port, audio output device, earphone, and/or other similar device, now known or later developed.

As shown in FIG. 3, the communications interface module 104 includes one or more wireless interfaces 112 and/or wired interfaces 114 that are generally configurable to communicate with the hearing prosthesis 60 via a communications connection 116, to a database 118 via a communications connection 120, or to other computing devices (not shown). Generally, the connection 116 is any wired or wireless connection to the external interface module 82 of the hearing prosthesis 60.

The wireless interface 112 includes one or more wireless transceivers, such as a Bluetooth transceiver, Wi-Fi transceiver, WiMAX transceiver, and/or other similar type of wireless transceiver configurable to communicate via a wireless protocol. The wired interface 114 includes one or more wired transceivers, such as an Ethernet transceiver, Universal Serial Bus (USB) transceiver, or similar transceiver configurable to communicate via a twisted pair wire, coaxial cable, fiber-optic link, or other similar physical connection.

The one or more processors 106 include one or more general purpose processors (e.g., microprocessors manufactured by Intel or Advanced Micro Devices) and/or one or more special purpose processors (e.g., digital signal processors, application specific integrated circuits, etc.). As depicted in FIG. 3, the one or more processors 106 are configured to execute computer-readable program instructions 124 that are contained in the data storage 108 and/or other instructions based on algorithms described herein.

The data storage 108 may include one or more computer-readable storage media that can be read or accessed by at least one of the processors 106. The one or more computer-readable storage media may include volatile and/or non-volatile storage components, such as optical, magnetic, organic or other memory or disc storage, which can be integrated in whole or in part with at least one of the processors 106. In some embodiments, the data storage 108 may be implemented using a single physical device (e.g., an optical, magnetic, organic or other memory or disc storage unit), while in other embodiments, the data storage may be implemented using two or more physical devices.

The data storage 108 includes computer-readable program instructions 124 and, in other embodiments, perhaps additional data. In some embodiments, for example, the data storage 108 additionally includes program instructions that perform or cause to be performed at least part of the herein-described methods and algorithms and/or at least part of the functionality of the systems described herein.

Figure 4:
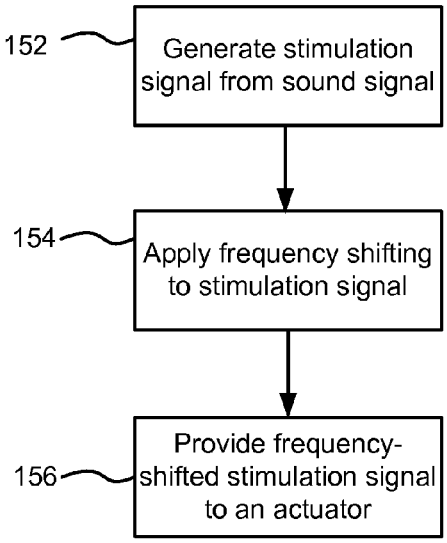
FIG. 4 is a flowchart showing a method or algorithm for applying frequency shifting according to an embodiment.

Referring now to FIG. 4 and with further reference the description above, one example method 150 is illustrated for applying frequency shifting for a hearing prosthesis. For illustration purposes, some features and functions are described herein with respect to a vibration-based hearing device. However, various features and functions may be equally applicable to other types of hearing prostheses.

The method 150 of FIG. 4 can be implemented by one or more of the hearing prostheses 20, 60 or the fitting system 100 described above. In the method 150, at block 152, a hearing prosthesis receives a sound signal and processes the sound signal to generate a stimulation signal. The stimulation signal is a representation of the sound signal that can be provided to an actuator and applied to a recipient to allow the recipient to perceive the stimulation signal as sound. Thus, the stimulation signal is generated from the sound signal in accordance with parameters of the recipient's hearing loss, such as a threshold level and a maximum comfort level, and perhaps parameters of the hearing prosthesis, such as gain and power capabilities.

Such stimulation signal would typically be applied by the actuator to the recipient to allow the recipient to perceive the original sound signal. However, in the present disclosure, at block 154, the hearing prosthesis applies frequency shifting to the simulation signal to generate a frequency-shifted stimulation signal. In the context of the disclosed examples, the frequency shifting would generally be applied by the electronics module 68 of FIG. 2. However, the frequency shifting can be programmed or otherwise modified by one or more of the electronics module 68 or the fitting system 100.

In the present disclosure, the frequency shifting is applied at block 154 not because of cochlea dead regions of the recipient, as may be the case for acoustic hearing aids, but rather to compensate for limitations of the hearing prosthesis in applying signals to the recipient that can be perceived as sound. For example, the hearing prosthesis may not be powerful enough to deliver high frequency sound signals to the recipient above a determined limit, which depends on the design of the device and on the hearing loss of the recipient. For instance, device power limitations can be due to a limited transducer size or capability, and/or on a skin flap thickness in the case of a transcutaneously coupled device. The output limit of a hearing prosthesis for a particular recipient can be determined during a fitting session or using population models.

Consequently, in the present example, at block 154, the hearing prosthesis can determine or identify that a portion of the stimulation signal is associated with frequencies above an output limit of the hearing prosthesis for the recipient. For example, some vibration-based hearing devices may have an output limit between around 3 kHz to 8 kHz for different recipients, such that frequency shifting can be applied when the stimulation signal includes some minimum threshold of portions associated with frequencies above the output limit. This does not necessarily mean that only portions of the stimulation signal above the output limit are frequency shifted but, rather, that the determination that portions of the stimulation signal are above the output limit can be used to trigger frequency shifting. Once frequency shifting is triggered, the frequency shifting can be usefully applied to portions of the stimulation signal above and/or below the output limit.

In the present example, at block 156, the frequency-shifted stimulation signal is provided to the actuator, which can then apply the frequency-shifted stimulation signal to the recipient to allow the recipient to perceive the original sound signal. For instance, the hearing prosthesis can be a vibration-based hearing device, such that the frequency-shifted stimulation signal can be provided to a vibration mechanism to apply vibrations corresponding to the frequency-shifted stimulation signal directly or indirectly to the recipient.

Generally, in the present disclosure, the frequency shifting applied at block 154 can imply a number of different approaches to processing electrical signals. A first example of frequency shifting is frequency compression, which refers to converting an original, larger frequency range into a smaller frequency range. Illustratively, frequency compression can be accomplished by discarding every n-th frequency channel or band and compressing the remaining frequency bands together in the frequency domain. For example, if an original sound signal had a range between about 2000 Hz and 8000 Hz, frequency compression could be applied to convert the sound signal into a corresponding frequency-shifted stimulation signal with a smaller range, such as between about 4000 Hz and 6000 Hz. The frequency-compressed stimulation signal can, in whole or in part, replace or include sound data that was in the original sound signal in the 4000-6000 Hz frequency range.

A second example of frequency shifting is frequency transposition, which refers to moving a first frequency range into a different (although perhaps overlapping) second frequency range. In frequency transposition, electrical signals in the first frequency range can at least partially replace or combine with electrical signals in the second frequency range. For example, if a portion of an original sound signal includes sound data within a first range between about 6000 Hz and 8000 Hz, frequency transposition could be applied to convert that portion of the sound signal into a corresponding frequency-shifted stimulation signal with a second range between about 2000 Hz and 4000 Hz. As mentioned above, this frequency-shifted stimulation signal from the first range to the second range can at least partially replace or combine with any sound data that was originally in the second range.

Generally, at block 154, the frequency shifting can include frequency compression, frequency transposition, and/or perhaps other frequency shifting approaches. Further, at block 154, the frequency shifting can also be combined with sound level or amplitude adjustments. For instance, a high amplitude or loud sound signal that also has high frequency components can be frequency shifted to a lower frequency and also adjusted to a lower amplitude to help the recipient better perceive the sound signal.

Further, the frequency shifting at block 154 can be dependent, at least in part, on a variety of considerations. In one example, the frequency shifting includes a level dependent frequency shifting, in which one or more parameters of the frequency shifting are dependent on an input sound level and/or a degree of hearing loss. Such parameters may include, for example, an amount of frequency content to be shifted, an extent of the frequency shifting, whether frequency shifted content replaces or mixes with other sound content, etc.

In one example of level dependent frequency shifting, the sound signal level is divided into one or more ranges, such as high, middle, and low level ranges, and the frequency shifting can be characterized as a percentage frequency shift based on the ranges. For instance, a 100% frequency shift may include shifting a particular amount of the sound data in the top 30% of the audible frequency bandwidth (around 2 kHz) down into a lower frequency range. The particular amount of sound data to be shifted can be 100% or some other percentage of the sound data in the top 30% of the frequency bandwidth. Thus, for example, a 50% frequency shift can include shifting a lesser percentage of the sound data from the top 30% of the frequency bandwidth into the lower frequency range. This lesser percentage can be 50% less than the 100% frequency shift case or can be any other percentage. More particularly, because different percentage frequency shifts can implicate different parameters, such as amount of content, extent of the shift, and mixing of sound content, generally, an X % frequency shift may not necessarily correspond to an identical X % adjustment in a particular parameter.

Alternatively or in combination, a 50% frequency shift may include shifting the particular amount of the sound data in the top 30% of the frequency bandwidth to a lesser extent (perhaps, but not necessarily 50% less) than in the case of a 100% frequency shift. Further, in an example of mixing frequency shifted sound content with original sound content, a 100% frequency shift may include mixing all of the shifted sound content with original sound content and a 50% frequency shift may include mixing 50% of the shifted sound content with the original sound content. Generally, various combinations of the above parameters can be effected by different percentage frequency shifts.

As mentioned above, the sound signal level can be divided into various ranges and different percentage frequency shifts can be applied for different sound level ranges. Generally, a greater frequency shift can be applied for lower level sound signals and a lesser frequency shift can be applied for higher level sound signals. In one non-limiting example, an about 100% frequency shift can be applied for levels below about 50 dB, an about 50% frequency shift can be applied for levels between about 50-70 dB, and an about 20% frequency shift can be applied for levels above about 70 dB. Generally, the use of the word "about" (and similar terms) in the above example or elsewhere herein should be understood by one of ordinary skill in the art to mean that the corresponding number, percentage, quantity, or other term would encompass a reasonable range around the corresponding term.

In one example of level dependent frequency shifting, the recipient's hearing loss levels are divided into one or more ranges, such as high, middle, and low hearing loss ranges, and the frequency shifting can be characterized as a percentage frequency shift based on the ranges. With reference to the above disclosure, generally, a greater frequency shift can be applied for greater hearing loss and a lesser frequency shift can be applied for lesser hearing loss. In one non-limiting example, an about 20% frequency shift can be applied for hearing loss levels between about 30-45 dB HL, an about 50% frequency shift can be applied for hearing loss levels between about 45-65 dB HL, and an about 100% frequency shift can be applied for hearing loss levels above about 65 dB HL. In this example, the frequency shift can also be limited to certain portions of the sound data, such as portions of the sound data in the top 30% of the frequency bandwidth.

In another example, the frequency shifting at block 154 can be dependent, at least in part, on operating parameters of the hearing prosthesis. For instance, frequency shifting can be applied differently based on whether the device is operating in a single-sided mode or a bilateral mode. More particularly, greater frequency shifting can be applied in the single-sided mode, which will alter the sound perception by the recipient from the contralateral side and hence improve lateralization by making the sound perception different by both ears. Frequency shifting can also be applied in the bilateral mode, although perhaps to a lesser extent than in the single-sided mode, to improve lateralization.

The frequency shifting at block 154 can also be dependent, at least in part, on a gain level of the hearing prosthesis. For example, during normal use, when a recipient adjusts a volume control of the hearing prosthesis to increase the gain, a lesser degree of frequency shifting can be applied at block 154. The reason for this relationship between increasing gain and decreasing frequency shifting is that the hearing prosthesis has typically been configured for the recipient during a fitting session. Consequently, if the recipient increases the gain in a particular environment, the dynamic range of the prosthesis for the recipient will allow the recipient to perceive higher frequency sounds. However, if the recipient increases the volume or gain above a maximum output level of the prosthesis, then a greater degree of frequency shifting can be applied at block 154 because this indicates that the recipient is having trouble perceiving higher frequency sounds.

Further, the frequency shifting at block 154 can also be dependent, at least in part, on a type of hearing loss, e.g., conductive or sensorineural, For example, in the case of conductive hearing loss, a lesser degree of frequency shifting can be applied to take advantage of remaining high frequency hearing to provide a more natural perception of incoming sound. In the case of sensorineural hearing loss, a greater degree of frequency shifting can be applied, for example to help improve speech understanding in noisy environments when there are output limitations on the prosthesis.

In yet another example, the frequency shifting at block 154 can be dependent, at least in part, on different listening situations, such as speech, noise, music, etc. Illustratively, if the recipient were listening to music, then less frequency shifting can be applied as compared to if the recipient were listening to speech. In this example, the hearing prosthesis processes the sound signal to classify the sound into primarily one or more classes, e.g., speech or music.

In a further example, the frequency shifting at block 154 can be dependent, at least in part, on whether the hearing prosthesis, in this case a vibration-based hearing device, includes a transcutaneous or percutaneous coupling to the recipient. In this example, greater frequency shifting can be applied in the transcutaneous case to compensate for greater attenuation of higher frequency signals applied as vibration through the skin. As discussed above, in the percutaneous case, the hearing prosthesis is coupled directly to the recipient's bone, which reduces the effect of attenuation caused by applying vibrations through the recipient's skin. Further, the skin flap thickness, the position of the coupling between the hearing prosthesis and the recipient, and/or the type of coupling between the prosthesis and the recipient can impact the application of frequency shifting. Generally, the skin flap thickness, the position of the coupling, and the type of coupling impact the degree of signal attenuation in different ways and the greater the attenuation the more frequency shifting will be applied. Illustratively, less frequency shifting can be applied when the coupling is an abutment compared to when the coupling is softband.

In another aspect of the present disclosure, the degree of attenuation in the transcutaneous case can be detected and the frequency shifting can be dependent, at least in part, on the detected attenuation. In one example, the attenuation can be detected using the head related transfer function (HRTF) from the stimulation point of the prosthesis to the cochlea. More particularly, the attenuation can be determined by comparing a traditional bone conduction and air conduction hearing loss threshold measurement. If the hearing threshold for a higher frequency cannot be detected due to an output limitation of the prosthesis, then frequency shifting can be applied in this case.

In another example, if the measured hearing threshold is close to the maximum output of the device, then frequency shifting can be applied. Illustratively, if the measured hearing threshold is less than 15 dB from the maximum output level, then a greater degree of frequency shifting can be applied. In another example, if the measured hearing threshold is less than 3 dB from the maximum output level, then a greater degree of frequency shifting can be applied.

In addition, the frequency shifting at block 154 can include voice-dependent frequency shifting, in which the frequency shifting is dependent on one or more frequency bands associated with a voice of a hearing prosthesis recipient. More particularly, less frequency shifting can be applied in frequency bands where a high amount of the recipient's own voice exists.

Further, various combinations of all of the above examples can also be used to control frequency shifting. For example, the frequency shifting can be based on a single-sided mode and on hearing loss levels in one or both ears. Generally, each block 152-156 of FIG. 4 may represent a module, a segment, or a portion of program code that includes one or more instructions executable by a processor for implementing specific logical functions or steps in the process. The program code may be stored on any type of computer readable medium or storage device including a disk or hard drive, for example. The computer readable medium may include a non-transitory computer readable medium, such as computer-readable media that stores data for short periods of time like register memory, processor cache, and Random Access Memory (RAM). The computer readable medium may also include non-transitory media, such as secondary or persistent long term storage, like read only memory (ROM), optical or magnetic disks, compact-disc read only memory (CD-ROM), etc. The computer readable medium may also include any other volatile or non-volatile storage systems. The computer readable medium may be considered a computer readable storage medium, for example, or a tangible storage device. In addition, one or more of the blocks 152-156 may represent circuitry that is wired to perform the specific logical functions of the method 150.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A method comprising:

programming a sound processor to apply frequency shifting on a stimulation signal to generate a frequency shifted stimulation signal, wherein the frequency shifting depends on one or more of a decibel level of a received sound signal, a hearing loss level associated with generating the stimulation signal, attenuation of an output based on the frequency shifted stimulation signal, or operating a hearing prosthesis in a single sided mode or a bilateral mode receiving a sound signal;

generating the stimulation signal from the sound signal;

applying the frequency shifting to the stimulation signal to generate the frequency shifted stimulation signal; and generating, by an actuator of the hearing prosthesis, the output based on the frequency shifted stimulation signal, wherein the output is configured to be perceived as sound.

2. The method of claim 1, wherein programming the sound processor to apply frequency shifting includes programming the sound processor to apply level dependent frequency shifting based on the decibel level of the received sound signal, wherein the level dependent frequency shifting applies a first degree of frequency shifting for a first decibel level of the sound signal or a second degree of frequency shifting for a second decibel level of the sound signal, and wherein the first degree of frequency shifting is greater than the second degree of frequency shifting, and the first decibel level is lower than the second decibel level.

3. The method of claim 1, wherein programming the sound processor to apply frequency shifting includes programming the sound processor to apply hearing loss dependent frequency shifting based on the hearing loss level, wherein the hearing loss dependent frequency shifting applies a first degree of frequency shifting for a first hearing loss level or a second degree of frequency shifting for a second hearing loss level, and wherein the first degree of frequency shifting is greater than the second degree of frequency shifting, and the first hearing loss level is greater than the second hearing loss level.

4. The method of claim 1, wherein programming the sound processor to apply frequency shifting includes programming the sound processor to apply attenuation dependent frequency shifting based on the attenuation of the output, wherein the attenuation dependent frequency shifting applies a first degree of frequency shifting for a first attenuation of the output or a second degree of frequency shifting for a second attenuation of the output, and wherein the first degree of frequency shifting is greater than the second degree of frequency shifting, and the first attenuation is greater than the second attenuation.

5. The method of claim 4, wherein the first attenuation is associated with the actuator configured for a transcutaneous coupling to a recipient of the hearing prosthesis, and the second attenuation is associated with the actuator configured for a percutaneous coupling to the recipient.

6. The method of claim 1, wherein programming the sound processor to apply frequency shifting includes programming the sound processor to apply mode dependent frequency shifting based on whether the hearing prosthesis is operating in the single sided mode or the bilateral mode, wherein the mode dependent frequency shifting applies a greater degree of frequency shifting when operating the hearing prosthesis in the single side mode compared to operating the hearing prosthesis in the bilateral mode.

7. The method of claim 1, wherein the actuator is a vibrating actuator configured to impart vibration, via a coupling apparatus, to a bone structure of a recipient of the hearing prosthesis.

8. The method of claim 1, wherein programming the sound processor to apply frequency shifting includes programming the sound processor to apply voice dependent frequency shifting that depends on one or more frequency bands associated with a voice of a recipient of the hearing prosthesis, wherein the voice dependent frequency shifting applies a first degree of frequency shifting for a first frequency band of the received sound signal and a second degree of frequency shifting for a second frequency band of the received sound signal, and wherein the first degree of frequency shifting is less than the second degree of frequency shifting, and the first frequency band includes a higher amount of the one or more frequency bands associated the voice of the recipient than the second frequency band.

9. A device comprising:

a sound input element configured to receive a sound signal, and to convert the sound signal into an electrical signal;

a sound processor configured to generate a stimulation signal based on the electrical signal, and to apply frequency shifting on the stimulation signal to generate a frequency shifted stimulation signal, wherein the frequency shifting depends on one or more of a decibel level of the received sound signal, a hearing loss level associated with generating the stimulation signal, attenuation of an output based on the frequency shifted stimulation signal, or operating in a single sided mode or a bilateral mode; and an actuator configured to generate the output based on the frequency shifted stimulation signal, wherein the output is configured to be perceived as sound.

10. The device of claim 9, wherein the sound processor is configured to apply level dependent frequency shifting based on the decibel level of the received sound signal, wherein the level dependent frequency shifting applies a first degree of frequency shifting for a first decibel level of the sound signal or a second degree of frequency shifting for a second decibel level of the sound signal, and wherein the first degree of frequency shifting is greater than the second degree of frequency shifting, and the first decibel level is lower than the second decibel level.

11. The device of claim 9, wherein the sound processor is configured to apply hearing loss dependent frequency shifting based on the hearing loss level, wherein the hearing loss dependent frequency shifting applies a first degree of frequency shifting for a first hearing loss level or a second degree of frequency shifting for a second hearing loss level, and wherein the first degree of frequency shifting is greater than the second degree of frequency shifting, and the first hearing loss level is greater than the second hearing loss level.

12. The device of claim 9, wherein the sound processor is configured to apply attenuation dependent frequency shifting based on the attenuation of the output, wherein the attenuation dependent frequency shifting applies a first degree of frequency shifting for a first attenuation of the output or a second degree of frequency shifting for a second attenuation of the output, and wherein the first degree of frequency shifting is greater than the second degree of frequency shifting, and the first attenuation is greater than the second attenuation.

13. The device of claim 12, wherein the first attenuation is associated with the actuator configured for a transcutaneous coupling to a recipient of the device, and the second attenuation is associated with the actuator configured for a percutaneous coupling to the recipient.

14. The device of claim 9, wherein the sound processor is configured to apply mode dependent frequency shifting based on whether the device is operating in the single sided mode or the bilateral mode, wherein the mode dependent frequency shifting applies a greater degree of frequency shifting when operating in the single side mode compared to operating in the bilateral mode.

15. The device of claim 9, wherein the sound processor is further configured to modify the frequency shifting based on machine learning of adjustments to one or more parameters of the device.

16. An article of manufacture including a non-transitory computer readable medium with instructions stored thereon, the instructions comprising:

instructions for generating a stimulation signal from a sound signal;

instructions for applying frequency shifting to the stimulation signal to generate a frequency shifted stimulation signal, wherein the frequency shifting depends on one or more of a decibel level of the sound signal, a hearing loss level associated with generating the stimulation signal, attenuation of an output based on the frequency shifted stimulation signal, or operating a hearing prosthesis in a single sided mode or a bilateral mode; and instructions for providing the frequency shifted stimulation signal to an actuator of the hearing prosthesis, wherein the actuator is configured to generate an output based on the frequency shifted stimulation signal, and wherein the output is configured to perceived as sound.

17. The article of manufacture of claim 16, wherein the frequency shifting is level dependent frequency shifting based on the decibel level of the received sound signal, wherein the level dependent frequency shifting applies a first degree of frequency shifting for a first decibel level of the sound signal or a second degree of frequency shifting for a second decibel level of the sound signal, and wherein the first degree of frequency shifting is greater than the second degree of frequency shifting, and the first decibel level is lower than the second decibel level.

18. The article of manufacture of claim 16, wherein the frequency shifting is hearing loss dependent frequency shifting based on the hearing loss level, wherein the hearing loss dependent frequency shifting applies a first degree of frequency shifting for a first hearing loss level or a second degree of frequency shifting for a second hearing loss level, and wherein the first degree of frequency shifting is greater than the second degree of frequency shifting, and the first hearing loss level is greater than the second hearing loss level.

19. The article of manufacture of claim 16, wherein the frequency shifting is attenuation dependent frequency shifting based on the attenuation of the output, wherein the attenuation dependent frequency shifting applies a first degree of frequency shifting for a first attenuation of the output or a second degree of frequency shifting for a second attenuation of the output, and wherein the first degree of frequency shifting is greater than the second degree of frequency shifting, and the first attenuation is greater than the second attenuation.

20. The article of manufacture of claim 16, wherein the frequency shifting is mode dependent frequency shifting based on whether the device is operating in the single sided mode or the bilateral mode, wherein the mode dependent frequency shifting applies a greater degree of frequency shifting when operating in the single side mode compared to operating in the bilateral mode.

* * * * *